US005805042A

United States Patent [19]

Chastain et al.

[11] Patent Number: 5,805,042

[45] Date of Patent: Sep. 8, 1998

[54] RADIO FREQUENCY LOW HUM-MODULATION AC BYPASS COIL

[75] Inventors: Jack B. Chastain, Chamblee; Sou-Pen Su, Lawrenceville, both of Ga.

[73] Assignee: Scientific-Atlanta, Inc., Norcross, Ga.

[21] Appl. No.: 828,585

[22] Filed: Mar. 31, 1997

[51] Int. Cl.[6] ..... H01F 27/28; H01F 38/20; H01F 21/02; H01F 7/38

[52] U.S. Cl. ..... 336/170; 336/174; 336/180; 336/147; 336/175; 333/131; 333/181; 333/185

[58] Field of Search ..... 336/170, 171, 336/174–175, 180–183, 69, 147; 333/131, 181, 185

[56] References Cited

U.S. PATENT DOCUMENTS

| | | | |
|---|---|---|---|
| 4,394,631 | 7/1983 | Pavlic | 333/132 |
| 4,641,115 | 2/1987 | Bailey | 333/181 |
| 5,032,808 | 7/1991 | Reddy | 336/170 |
| 5,483,208 | 1/1996 | Spriester | 336/224 |

*Primary Examiner*—Michael L. Gellner
*Assistant Examiner*—Anh Mai
*Attorney, Agent, or Firm*—Kenneth M. Massaroni; Kelly A. Gardner; Hubert J. Barnhardt, III

[57] ABSTRACT

A radio frequency choke for use in a cable television transmission and distribution circuit is disclosed. The radio frequency choke comprises a core of zinc-ferrite material as provided by MMG/NEOSID, Ltd., part number 31P0250012, and a wire coil wound around the core. The coil includes a first lead, a first clockwise winding of N1 turns around the core, the first lead being connected to an input of the first winding, a second counterclockwise winding of N2 turns around the core, a third counterclockwise winding of N3 turns around the core, and a second lead connected to an output of the fourth winding. In a preferred embodiment, there are six turns in the first clockwise winding, five turns in the second clockwise winding, and five turns in the third counterclockwise winding. Moreover, in the preferred embodiment, resonance damping resistors of approximately 2 KΩ are connected between the windings of the radio frequency choke.

11 Claims, 5 Drawing Sheets

| FREQ (MHz) | HUM (mVp-p) | HUM (dB) |
|---|---|---|
| 5 | 0.30 | 69.7 |
| 10 | 0.20 | 73.2 |
| 15 | 0.18 | 74.2 |
| 20 | 0.18 | 74.2 |
| 25 | 0.18 | 74.2 |
| 30 | 0.14 | 76.3 |
| 40 | 0.12 | 77.7 |
| 50 | 0.14 | 76.3 |
| 55 | 0.18 | 74.2 |
| 75 | 0.14 | 76.3 |
| 100 | 0.14 | 76.3 |
| 150 | 0.08 | 81.2 |
| 200 | 0.09 | 80.2 |
| 250 | 0.08 | 81.2 |
| 300 | 0.08 | 81.2 |
| 350 | 0.05 | 85.3 |
| 400 | 0.06 | 83.7 |
| 450 | 0.06 | 83.7 |
| 500 | 0.08 | 81.2 |
| 550 | 0.08 | 81.2 |
| 600 | 0.10 | 79.3 |
| 650 | 0.10 | 79.3 |
| 700 | 0.12 | 77.7 |
| 750 | 0.16 | 75.2 |
| 800 | 0.28 | 70.3 |
| 850 | 0.10 | 79.3 |
| 900 | 0.10 | 79.3 |
| 950 | 0.10 | 79.3 |
| 1000 | 0.20 | 73.2 |
| AVERAGE | | 77.74 |
| STD DEVIATION | | 3.92 |
| MIN | | 69.73 |
| MEDIAN | | 77.69 |

| FREQ (MHz) | HUM (mVp-p) | HUM (dB) |
|---|---|---|
| 5 | 0.40 | 67.2 |
| 10 | 0.30 | 69.7 |
| 15 | 0.34 | 68.6 |
| 20 | 0.38 | 67.7 |
| 25 | 0.34 | 68.6 |
| 30 | 0.28 | 70.3 |
| 40 | 0.22 | 72.4 |
| 50 | 0.24 | 71.7 |
| 55 | 0.22 | 72.4 |
| 75 | 0.18 | 74.2 |
| 100 | 0.18 | 74.2 |
| 150 | 0.09 | 80.2 |
| 200 | 0.09 | 80.2 |
| 250 | 0.10 | 79.3 |
| 300 | 0.10 | 79.3 |
| 350 | 0.18 | 74.2 |
| 400 | 0.25 | 71.3 |
| 450 | 0.20 | 73.2 |
| 500 | 0.18 | 74.2 |
| 550 | 0.25 | 71.3 |
| 600 | 0.26 | 71.0 |
| 650 | 0.26 | 71.0 |
| 700 | 0.28 | 70.3 |
| 750 | 0.24 | 71.7 |
| 800 | 0.40 | 67.2 |
| 850 | 0.18 | 74.2 |
| 900 | 0.10 | 79.3 |
| 950 | 0.08 | 81.2 |
| 1000 | 0.30 | 69.7 |
| AVERAGE | | 72.96 |
| STD DEVIATION | | 4.15 |
| MIN | | 67.23 |
| MEDIAN | | 71.67 |

| FREQ (MHz) | HUM (mVp-p) | HUM (dB) |
|---|---|---|
| 5 | 0.36 | 68.1 |
| 10 | 0.20 | 73.2 |
| 15 | 0.24 | 71.7 |
| 20 | 0.30 | 69.7 |
| 25 | 0.32 | 69.2 |
| 30 | 0.30 | 69.7 |
| 40 | 0.24 | 71.7 |
| 50 | 0.28 | 70.3 |
| 55 | 0.30 | 69.7 |
| 75 | 0.28 | 70.3 |
| 100 | 0.24 | 71.7 |
| 150 | 0.18 | 74.2 |
| 200 | 0.14 | 76.3 |
| 250 | 0.12 | 77.7 |
| 300 | 0.14 | 76.3 |
| 350 | 0.20 | 73.2 |
| 400 | 0.40 | 67.2 |
| 450 | 0.28 | 70.3 |
| 500 | 0.30 | 69.7 |
| 550 | 0.34 | 68.6 |
| 600 | 0.30 | 69.7 |
| 650 | 0.38 | 67.7 |
| 700 | 0.40 | 67.2 |
| 750 | 0.24 | 68.6 |
| 800 | 0.64 | 63.1 |
| 850 | 0.50 | 65.3 |
| 900 | 0.20 | 73.2 |
| 950 | 0.14 | 76.3 |
| 1000 | 0.22 | 72.4 |
| AVERAGE | | 70.79 |
| STD DEVIATION | | 3.40 |
| MEDIAN | | 70.33 |

RADIO FREQUENCY LOW HUM-MODULATION AC BYPASS COIL

BACKGROUND OF THE INVENTION

1. Technical Field

This invention generally relates to cable television ("CATV") transmission and distribution systems and, more specifically, to an improved alternating current ("AC") bypass coil (also known as and hereinafter referred to as a radio frequency ("RF") choke) for separating an AC power signal from broadband RF signals, where both the AC power signal and the broadband RF signals are transmitted on the same cable.

2. Description of Related Art

Frequency diplexing is common in CATV transmission and distribution systems. That is, RF and AC power signals are simultaneously transmitted over a coaxial cable. In a typical CATV transmission and distribution system, RF signals are transmitted from a central location known as the "headend" to a number of subscribers. Subscribers may also send information back to the headend. RF signals sent from the headend to the subscribers are typically broadband signals in a frequency band of 50 MHz to 1 GHz. Similarly, RF signals sent from the subscribers to the headend are broadband signals in a frequency band of 5 to 30 MHz. An AC power signal, typically a 50 or 60 Hz single-phased "quasi-square" wave shaped AC signal is also transmitted along with the RF signals to provide power to amplifiers and other devices located at various points along the cable. Newer CATV systems require high system AC currents to be transmitted over AC bypass coils and, as a result, this may cause hum distortion of the RF signals. The cumulative addition of all the hum distortion, if sufficiently large, may cause rolling bars on the television picture.

In these CATV and telecommunications transmission and distribution systems, RF chokes are typically used for separating the AC power from the broadband RF signals at points along the cable where the RF signals are to be processed by other RF active or passive devices, such as amplifiers, couplers, or splitters. After the RF devices, RF chokes are also provided for recombining the AC power signal with the broadband RF signals. Put another way, these RF chokes serve to isolate the RF devices from the AC power by bypassing high currents, typically 8 to 12 amperes, around the RF devices. Moreover, these RF chokes must also block passage of as much of the broadband signal as possible, so as to minimize the cumulative insertion loss across the entire cable from the headend to the subscribers. The wire used for the coil in these RF chokes must be large enough to carry these currents, i.e., 8–12 amperes. However, high currents pose problems in that core materials are more likely to reach saturation, thereby presenting the RF signals with an impedance which varies at the frequency rate of the AC power signal. The effect of this is unwanted modulation of RF signals and this problem is commonly known as hum-modulation or simply "hum mod".

The above described problems due to high AC current can be effectively reduced by careful selection of wire size, core material, core geometry, and winding of the wire. It is known in the art that there are many different winding schemes and core materials that may be used for RF chokes in CATV systems. For example, referring to FIG. 1, a prior-art choke coil 10 of U.S. Pat. No. 4,394,631 to Pavlic is shown which has a winding 12 of about 21 turns on a ferrite core 14. An input lead 16 and an output lead 18 extend from the ends of the winding 12. A resistor 20 is also provided as a resonance damping element and is connected in parallel with a portion of the winding 12 between the fourteenth turn and the output lead 18. The RF choke 10 has an effective band up to about 600 MHz. This type of choke coil is not effective, however, for use in CATV systems in which frequencies up to 1 GHz are employed.

Referring now to FIG. 2, another prior art RF choke 20 of U.S. Pat. No. 5,032,808 to Reddy is shown. This RF choke 20 has a core 22 of predetermined cross section and which can be made of ferrite or powered iron. On this core 22 is wound a coil 24 extending from an input lead 26. The coil 24 is formed of a single wire and is divided into three sections. The coil consists of a first winding 28 of five turns, connected to a single air coil 30 which wound off the coil, a second winding 32 consisting of seven turns connected to a single, loop air coil 34 also wound off the core 22, and a third winding 36 that consists of four turns, to which is connected to an output lead 38. A resonance-damping resistor 40, having a value of approximately 750 Ω, is connected in parallel with the third winding 36, and soldered to a midpoint of the air coil loop 34 and to the output lead 38. This RF choke provides satisfactory results under some but not all circumstances. For example, the Reddy RF choke does not provide for low hum-modulation for operation at a current of 12 amperes in a frequency band of up to 1 GHz. Therefore, there exists a need for a new and improved RF choke which provides better results than the current RF chokes.

SUMMARY OF THE INVENTION

In accordance with the present invention, a new and improved RF choke is disclosed for use in CATV systems over which RF signals are transmitted and distributed. The RF choke of the present invention provides low hum-modulation for operation at currents of 8, 10, and 12 amperes in a frequency band of about 5 MHz to 1 GHz.

The RF choke in accordance with the present invention comprises of a core of zinc-ferrite material as provided by MMG/NEOSID, Ltd., part number 31P0250012, a wire coil wound around the core, the coil including a first lead, a first clockwise winding of N1 turns around the core, the first lead being connected to an input side of the first winding, a second counterclockwise winding of N2 turns around the core, a third counterclockwise winding of N3 turns around the core, and a second lead connected to an output side of the third winding.

In a preferred embodiment, there are six turns in the first clockwise winding, five turns in the second counterclockwise winding, and five turns in the third counterclockwise winding. Moreover, in the preferred embodiment, resonance damping resistors of approximately 2,000 ("2K") Ω are also connected between the windings of the RF choke.

DETAILED DESCRIPTION

Figure 1:
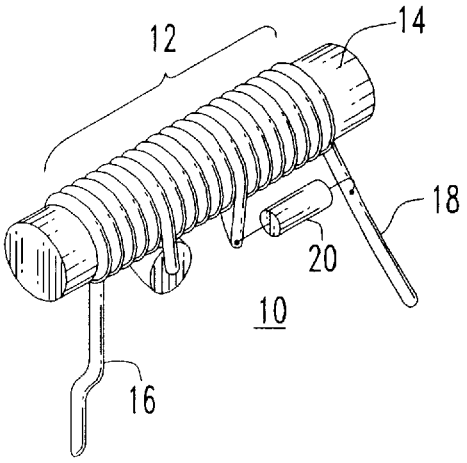
FIG. 1 PRIOR ART
FIG. 1 illustrates an RF choke of the prior art.
Figure 2:
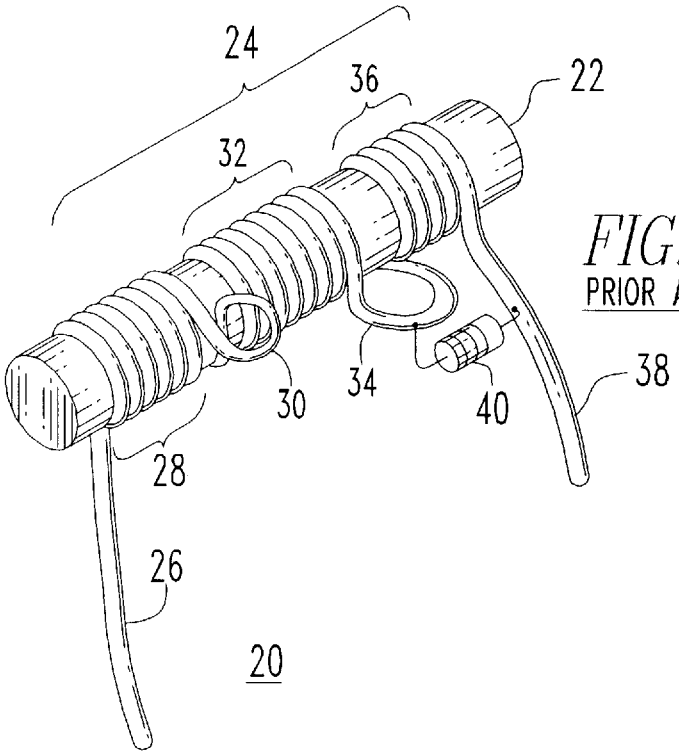
FIG. 2 PRIOR ART
FIG. 2 illustrates another RF choke of the prior art.
Figure 3:
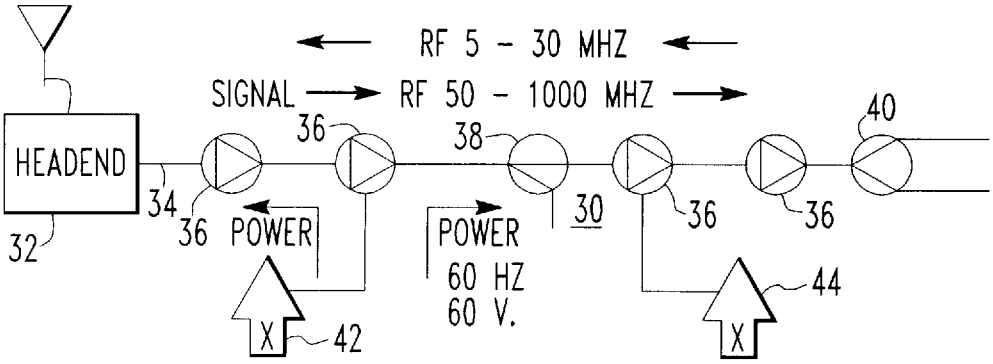
FIG. 3 is a partial schematic diagram of a CATV system in which RF choke coils of the present invention are used.

Referring to FIG. 3, there is shown an environment where an RF choke of the present invention is used in a CATV system 30. The CATV system 30 has a headend 32 with a coaxial cable 34 extending therefrom. Connected to the cable 34 are a number of in-line devices, such as amplifiers 36, a coupler 38, a splitter 40, and subscribers 42 and 44. As discussed above, signals from the headend 32 to subscribers 42 and 44 are typically carried in a signal band of 50 MHz to 1 GHz and signals from the subscribers 42 and 44 back to the headend 32 are carried in a signal band of about 5 to 30 MHz. Power for energizing the various devices, e.g., amplifiers 36, can be supplied at various places along the cable 34 to travel in either direction. This power is typically square-wave 60 Hz power supplied at nominal 60 volts. The cable 34 typically carries 8–12 amperes of current at 60 Hz.

Figure 4:
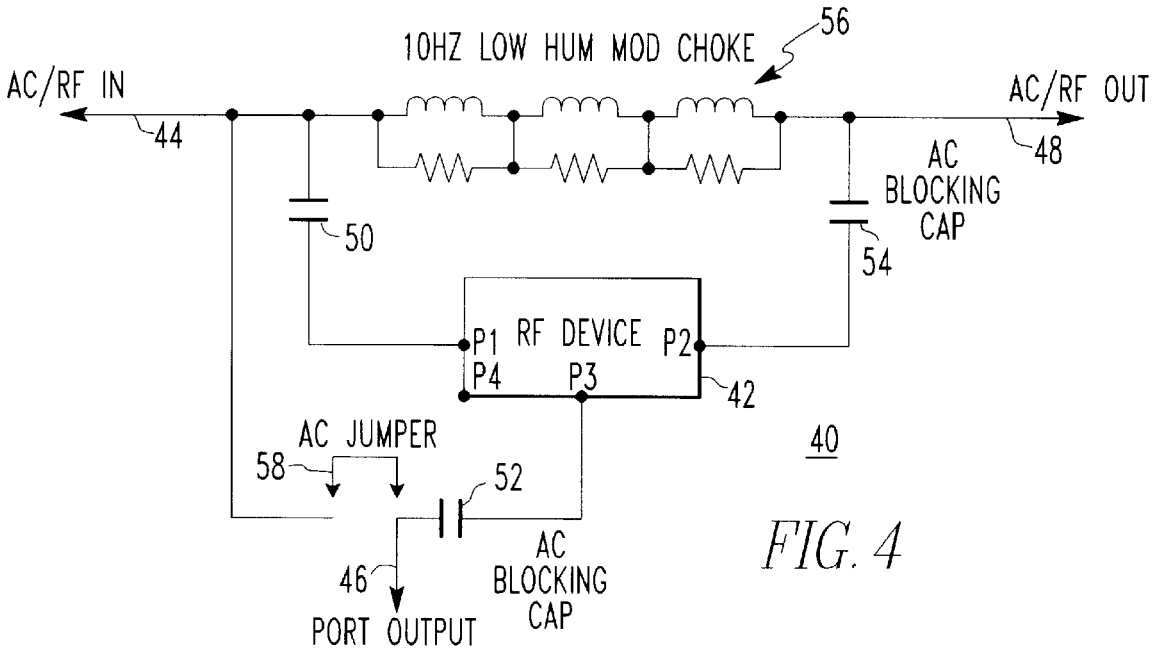
FIG. 4 is an electrical schematic diagram of a portion of a CATV system showing an RF device in combination with RF choke coils of the present invention.

Referring now to FIG. 4, a typical RF circuit 40 is shown of the type connected in-line, such as the amplifiers 36, coupler 38, and splitter 40 of FIG. 3. This circuit 40 can include an RF device 42 having an input terminal 44 and one or more output terminals 46 and 48. Isolation capacitors 50, 52, and 54 are connected to the RF device 42 in an RF path, these isolation capacitors having a value so as to exclude the 60 Hz power wave. An RF choke 56 is provided for bridging AC power to and/or from the various input and output terminals.

As is well known, an RF choke is an inductor which exhibits high reactance or impedance to signals in the RF frequency range and low impedance to signals of lower frequency, e.g., AC power signals. As such, these characteristic of RF chokes make them useful in the separation and combining of RF signals and AC power signals. An RF choke is typically constituted by a number of turns of magnet wire wound around a ferrite coil. Resistors are typically connected with a portion of the coil to dampen resonances caused by the windings of the RF choke.

Figure 5:
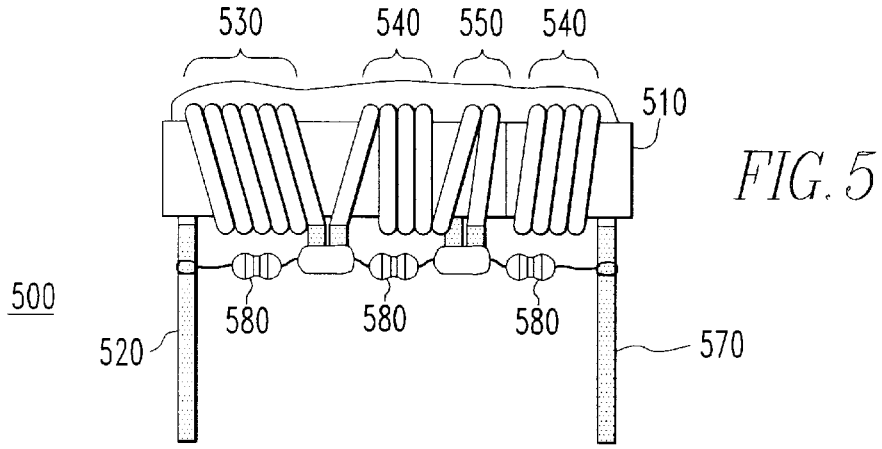
FIG. 5 illustrates an RF choke according to a preferred embodiment of the present invention.
Figure 6:
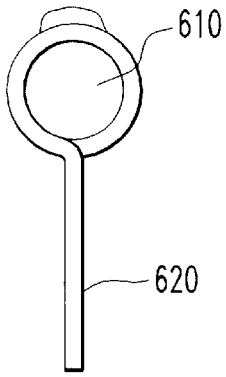
FIG. 6 illustrates a front view of the RF choke of FIG. 5.

Referring now to FIG. 5, it illustrates an RF choke 500 in accordance with the teachings of the present invention. RF choke 500 comprises of a core 510 of zinc-ferrite material as provided by MMG/NEOSID, Ltd., part number 31P0250012, a magnetic wire coil wound around the core 510, the coil including a fat lead 520, a first clockwise winding 530 of N1 turns around the core, the first lead being connected to an input side of the first winding, a second counterclockwise winding 540 of N2 turns around the core, a third counterclockwise winding 550 of N3 turns around the core, and a second lead 570 connected to an output side of the third winding. FIG. 6 illustrates the front view of the RF choke 500 of the present invention.

In a preferred embodiment, the wire coil is a 17 AWG, heavy build, NEMA, MW35C, 200° C., red or amber magnet wire. The coil has six turns in the first clockwise winding, five turns in the second counterclockwise winding, and five turns in the third counterclockwise winding. Resonance damping resistors 580 of approximately ⅛ Watt, 2 KΩ are connected between the windings of the RF choke. For example, a first 2 KΩ resistor 580 is connected between the input and output of the first clockwise winding 530, a second 2 KΩ resistor 580 is connected between an input and an output of the second counterclockwise winding 540, and a third 2 KΩ resistor 580 is connected between the input and output of the third counterclockwise winding 550. The glue used for holding the wire coil around the core 510 is Loctite UV352 cured.

Moreover, the core 510 is formed of a magnetic material having an initial permeability of about 220 and a saturation flux density of about 350 gauss. The preferred core has a temperature factor of about 12–30, Curie temperature of about 270° C., and a typical resistivity of $10^6$ Ω-cm. The core is approximately 1.5 inches long and has an outside diameter ("O.D.") of about 0.25 inches. Magnetic cores having these characteristics are commercially available by MMG/NEOSID, Ltd., of Paterson, N.J., with the core being identified by this company as part number 31P0250012.

Figure 7:
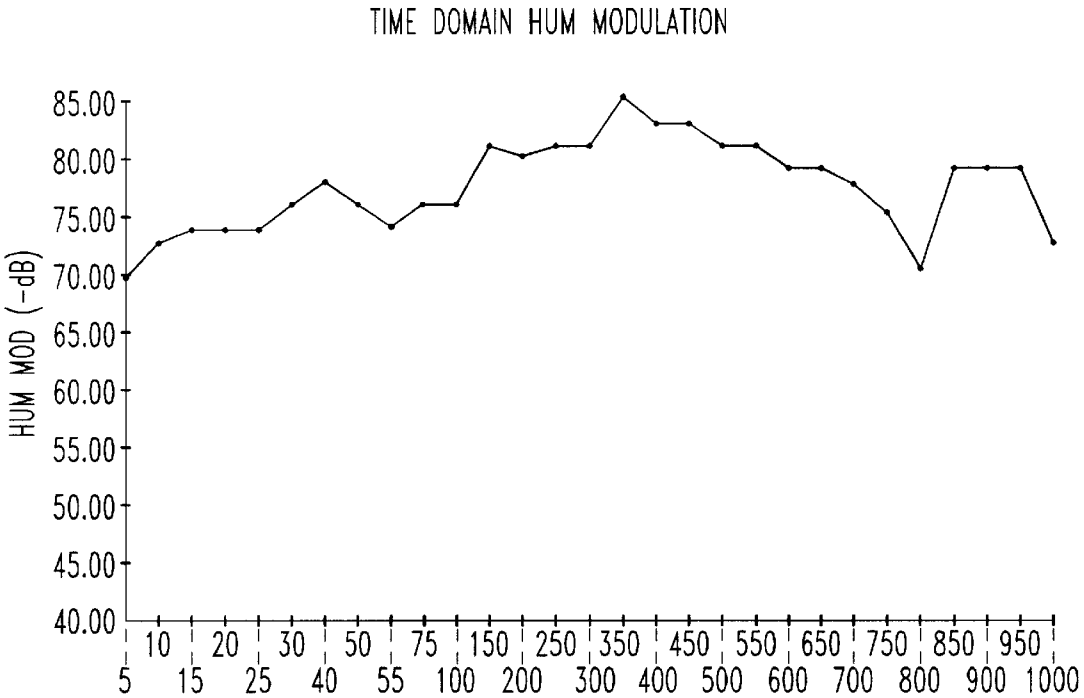
FIG. 7 is a chart showing the time domain hum AM distortion measurement of the RF choke of the present invention at 6 amperes.
Figure 8:
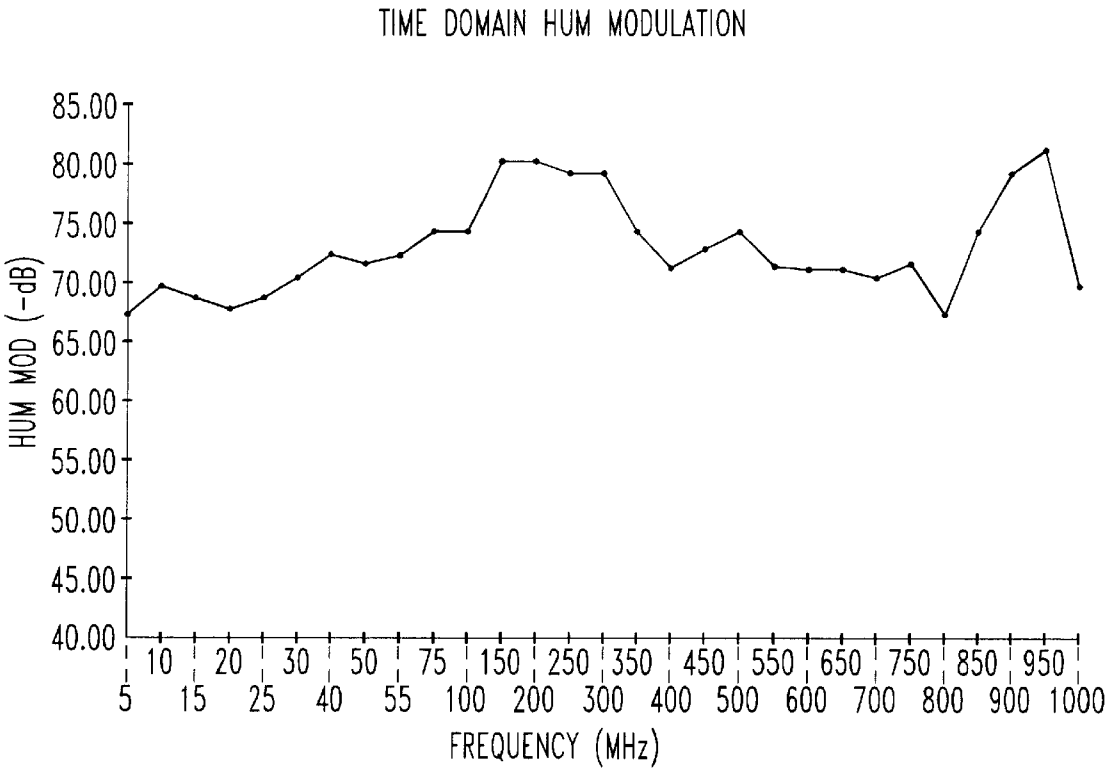
FIG. 8 is a chart showing the time domain hum AM distortion measurement of the RF choke of the present invention at 10 amperes.
Figure 9:
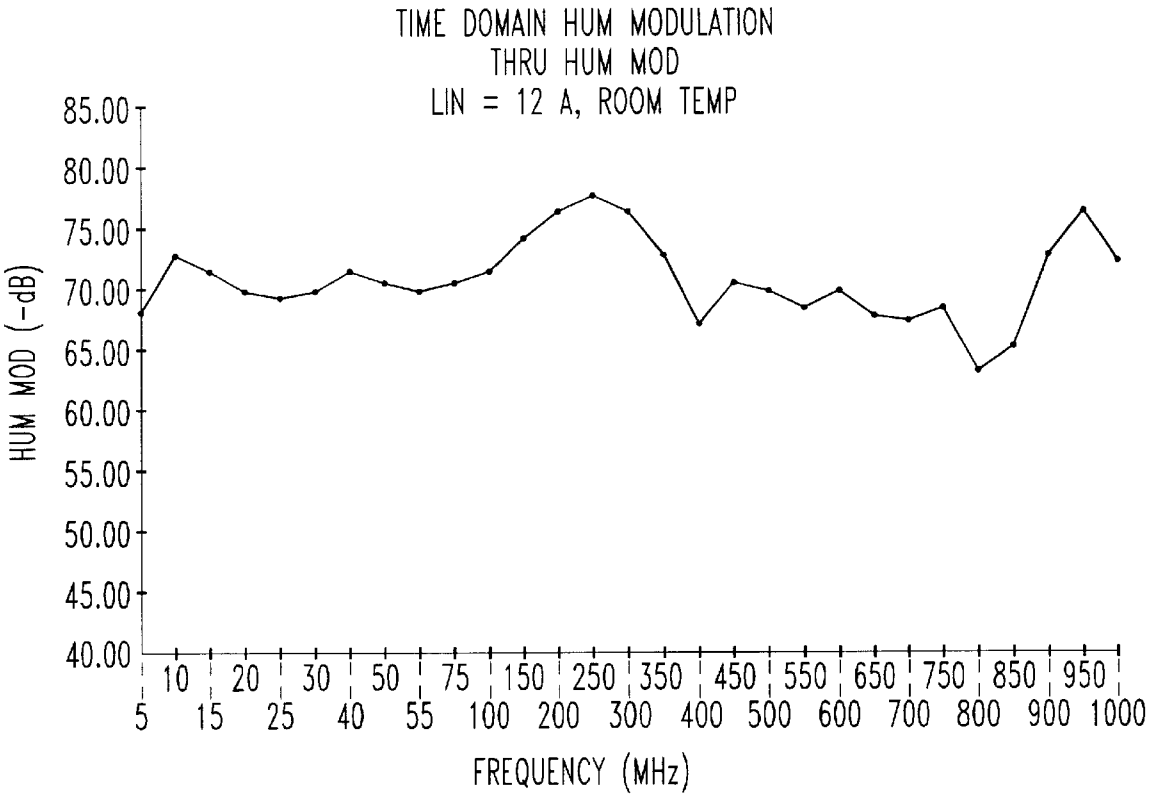
FIG. 9 is a chart showing the time domain hum AM distortion measurement of the RF choke of the present invention at 12 amperes.

By winding the coil as shown above and using the core material as provided by MMG/NEOSID, Ltd., the RF choke of the present invention provides high current carrying capacity, proper frequency response, and good hum-mod performance. Moreover, the RF choke provides effective and efficient dampening of parasitic resonances in the frequency range of 5 MHz to 1 GHz with minimal RF signal deterioration and losses in CATV transmission and distribution systems. This is illustrated in FIGS. 7–9 by the time domain hum AM distortion measurements of the RF choke of the present invention at 6, 10, and 12 amperes, respectively.

The variable of the particular cable system in which the RF chokes of the present invention are to be used dictates the configuration of the chokes. For example, the current carrying capacity of the RF chokes may be adjusted by increasing or reducing the gauge of the wire. Similarly, the range of frequency in which the RF signals are to be sent may also be adjusted by increasing or reducing the number of turns of the windings. In another embodiment of the present invention, an RF choke includes a core having characteristics similar to that of the MMG/NEOSID, Ltd., part number 31P0250012 and a coil formed of two windings of different number of turns. The coil is formed of an input lead, a first clockwise winding, a second counterclockwise winding, and an output lead. If desired, a resistor can be connected in parallel to the second counterclockwise winding.

While the invention has been described in detail with reference to a preferred embodiment and selected variations thereof, it should be apparent to those skilled in the art that many modifications and variations are possible without departure from the scope and spirit of this invention as defined in the appended claims.

We claim:

1. A radio frequency choke for use in a communication system, comprising:

a core of nickel-zinc ferrite material as provided by MMG/NEOSID, Ltd., part number 31P0250012; and a wire coil wound around said core, said wire coil including:

a first lead;

a first clockwise winding of N1 turns around said core, said first lead being connected to an input side of the first winding; a second counterclockwise winding of N2 turns around said core; and a third counterclockwise winding of N3 turns around said core;

a second lead connected to an output side of said third winding; and a first resonance damping resistor connected between the first lead and an output of the first winding; a second resonance damping resistor connected between an input and an output of the second winding; and a third resonance damping resistor connected between an input of the third winding and the second lead.

2. The radio frequency choke of claim 1, wherein said first clockwise winding is coupled in series with said second counterclockwise winding and said second counterclockwise winding is coupled in series with said third counterclockwise winding.

3. The radio frequency choke of claim 1, wherein N1=6 turns, N2=5 turns, and N3=5 turns.

4. The radio frequency choke of claim 1, wherein said core has a typical resistivity of $10^6\Omega$-cm.

5. The radio frequency choke of claim 1, wherein said first, second, and third resonance damping resistors are on the order of about 2 KΩ.

6. The radio frequency choke of claim 1, wherein said core has an initial permeability value of about 220.

7. The radio frequency choke of claim 1, wherein said core has a saturation flux density of about 350.

8. The radio frequency choke of claim 1, wherein said core has a loss factor of about 40 at 500 KHz, about 42 at 1 MHz, and about 50 at 2 MHz.

9. The radio frequency choke of claim 1, wherein said core has a temperature factor from about 12 to 30.

10. The radio frequency choke of claim 1, wherein said core has a Curie temperature of about 270° C.

11. A radio frequency choke for use in a communications system comprising:

a nickel-zinc ferrite core with characteristics similar to that of MMG/NEOSID, Ltd., part number 31P0250012;

first and second lead;

a first winding coupled to the first lead;

second and third windings in series with one another such that the second winding is in a clockwise direction and the third winding is in a counterclockwise direction, wherein the third winding is coupled to the second lead;

a first resonance damping resistor connected between the first lead and an output of the first winding;

a second resonance damping resistor connected between an input of the second winding and an output of the second winding; and a third resonance damping resistor connected between an input of the third winding and the second lead.

* * * * *